United States Patent [19]

Blakey et al.

[11] 4,181,526

[45] Jan. 1, 1980

[54] INTERPOLYMER PROTECTIVE OVERCOATS FOR ELECTROPHOTOGRAPHIC ELEMENTS

[75] Inventors: Cathy L. Blakey, Webster; Richard C. Sutton, Rochester, both of N.Y.

[73] Assignee: Eastman Kodak Company, Rochester, N.Y.

[21] Appl. No.: 916,174

[22] Filed: Jun. 16, 1978

[51] Int. Cl.[2] ..... G03G 5/14

[52] U.S. Cl. ..... 430/67; 526/272; 526/305; 526/317

[58] Field of Search ..... 96/1.5 R, 1.5 N

[56] References Cited

U.S. PATENT DOCUMENTS

| | | | |
|---|---|---|---|
| 3,753,709 | 8/1973 | Standemayer et al. | 96/1.5 R |
| 3,884,689 | 5/1975 | Limburg | 96/1.5 N X |
| 4,006,020 | 2/1977 | Polastri | 96/1.5 R |

OTHER PUBLICATIONS

"Photoconductive Elements Containing Polymeric Binders," Research Discl., 11680, Dec. 1973, pp. 130–133.

*Primary Examiner*—Roland E. Martin, Jr.
*Attorney, Agent, or Firm*—John R. Everett

[57] ABSTRACT

Overcoats for electrophotographic elements are provided. The overcoats comprise a polymer having recurring units of the structure:

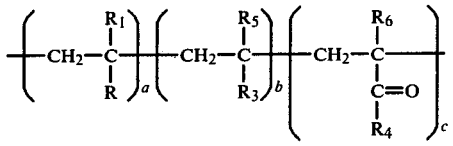

in which

R represents phenyl, tolyl, xylyl, or a

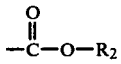

group;

$R_1$, $R_5$ and $R_6$, which may be the same or different represent hydrogen or methyl;

$R_2$ represents alkyl or aryl;

$R_3$ represents carboxyl, alkyl ester, aryl ester, alkylamide or arylamide group having at least one carboxyl or hydroxyl or carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

16 Claims, No Drawings

INTERPOLYMER PROTECTIVE OVERCOATS FOR ELECTROPHOTOGRAPHIC ELEMENTS

FIELD OF THE INVENTION

This invention relates to electrophotographic elements and to overcoat layers for use therein.

BACKGROUND OF THE INVENTION

In conventional electrophotographic office copy systems, it is generally desirable to employ a reusable light-sensitive photoconductive element. The reusable photoconductive element is employed to form an electrostatic charge pattern corresponding to an original image. The charge pattern is then developed using conventional electrostatically attractable toner particles. Subsequently the toner particle image is transferred to a final copy sheet, such as ordinary bond paper.

To improve the wear resistance, and thereby maximize efficiency in office copying devices, it has been found advantageous to provide protective overcoats for reusable photoconductive elements. Such protective overcoats may also be used on photoconductive elements which are used once or a few times but which are subjected to deleterious physical or chemical treatment(s) during processing.

It is known that scum and wear defects can be reduced by overcoating electrographic recording elements with polymeric materials. However, no overcoat materials have been discovered which are suitable for use in all electrographic recording elements. Many of the overcoat compositions disclosed in the prior art are not useful, for various reasons, as overcoats for aggregate photoconductive layers of the type disclosed by Light in U.S. Pat. No. 3,615,414 or Contois et al., U.S. Pat. No. 3,873,311. For an example, prior art overcoat compositions such as poly(methyl methacrylate), poly(methyl methacrylate-co-butyl acrylate) and poly(vinyl acetate) have low wear resistance and/or have deleterious effect on the imaging and electrical properties of aggregate photoconductive layers.

SUMMARY OF THE INVENTION

The present invention provides an electrically insulating overcoat layer for electrophotographic elements wherein said overcoat comprises a polymer having recurring units according to the structure:

I.

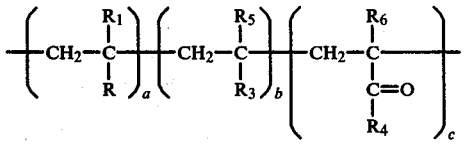

in which

R represents phenyl, tolyl, xylyl, or a

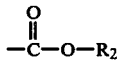

group;

$R_1$, $R_5$ and $R_6$, which may be the same or different, represent hydrogen or methyl;

$R_2$ represents alkyl or aryl;

$R_3$ represents carboxyl, alkyl ester, aryl ester, alkylamide or arylamide group having at least one carboxyl or hydroxyl or a carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

We have found that polymer overcoats having recurring units of the above structure, provide thin, wear-resistant overcoats for electrographic elements without deleteriously affecting the electrical properties of said elements. Because of the presence of the active methylene group, the polymers which are useful in the present invention are capable of cross linking when drying.

The term photoconductive layer is defined herein to include (1) a single layer containing a photoconductor and optionally, various binder and/or sensitizing addenda or (2) a multilayer configuration containing two or more separate photoconductor containing layers or (3) one or more separate photoconductor containing layers together with one or more separate layers containing sensitizing addenda for the photoconductor containing layer.

Useful carboxylic anhydrides include anhydrides such as acetic, succinic, glutaric, maleic and phthalic anhydrides.

Active methylene groups are defined herein to mean methylene groups between two activating groups. Examples of activating groups are electronegative groups such as cyano, carbonyl, sulfonyl and nitrile. Active methylene groups exhibit unusual chemical activity and are therefore referred to as active. Malonic esters, acetoacetic, cyanoacetic esters and 1,3-diketones are examples of aliphatic compounds containing such groups. Aliphatic groups containing active methylene groups are disclosed in many patents, as for example, U.S. Pat. Nos. 3,459,790; 3,488,708; 3,554,987 and 2,860,986. These patents are expressly incorporated herein by reference.

As used herein, alkyl refers to straight or branched chain alkyl groups of about 1 to about 10, preferably of about 1 to about 4 carbon atoms or aryl substituted alkyl groups wherein aryl refers to aromatic groups of about 6 to 10 carbon atoms which can have alkyl substituents as previously defined.

The overcoat layers of the present invention are useful with a wide variety of organic or inorganic photoconductive layers or elements. The overcoat layers are particularly useful as overcoats for organic photoconductive layers such as aggregate photoconductive elements of the type disclosed by Light in U.S. Pat. No. 3,615,414 and Contois et al. in U.S. Pat. No. 3,873,311. The aggregate photoconductive layers comprise aggregate photoconductive compositions having a multiphase structure comprising (a) a discontinuous phase comprising a co-crystalline compound or complex of a pyrylium-type dye salt and an electrically insulating film forming polymeric material containing an alkylidene diarylene group as a recurring unit; and (b) a continuous phase comprising an electrically insulating film forming polymeric material. Such aggregate photoconductive layers may contain additional addenda as described in the aforementioned Light and Contois et al. patents.

PREFERRED EMBODIMENT OF THE INVENTION

In a preferred embodiment the present invention provides an electrically insulating overcoat layer for electrophotographic elements wherein said overcoat comprises a polymer having recurring units according to the structure:

II.

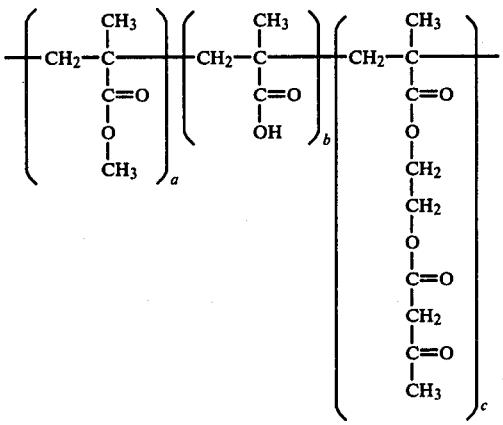

a is about 50 to about 80 weight percent of said polymer;

b is about 2 to about 25 weight percent of said polymer; and c is about 2 to about 25 weight percent of said polymer.

An especially preferred embodiment of the present invention provides an overcoat layer as described above that also includes a cross-linking agent.

The present invention makes possible electrophotographic elements comprising, in the following order:

a support;

an electrically conducting layer;

a photoconductive layer; and an electrically insulating overcoat layer as described above.

The overcoat layers of the present invention are especially useful in electrophotographic elements that include an aggregate photoconductive layer.

In general the polymers used to form overcoats according to present inventions should have a glass transition temperature (Tg) of between about 40° to about 120° C., preferably about 65° to about 120° C. If the glass transition temperature (Tg) is less than about 40° C., the polymers of the present invention form coatings that are too soft and tacky. When the glass transition temperature is above about 120° C., the copolymer forms coatings which do not readily coalesce. Such coatings are often not smooth and continuous and become too brittle. However, Tg temperatures outside these ranges are useful especially if used with a plasticizer. Glass transition temperatures (Tg) are determined according to the procedure described in Techniques and Methods of Polymer Evaluation, Vol. 1, Marcel Dekker, Inc., (1966).

The molecular weight of the polymers may vary widely. It is only necessary that the polymer be soluble in the carrier or medium from which said polymer is coated. Generally, weight average molecular weights (Mw) in the range of about 100,000 to about 2 million, preferably about 200,000 to about 750,000 are useful.

The polymers of the present invention can be prepared by any of the addition polymerization techniques known to those skilled in the art such as solution polymerization, bulk polymerization, bead polymerization and emulsion polymerization. These techniques are carried out in the presence of a free radical generating polymerization initiator, such as peroxy compounds, e.g., (benzoyl peroxide, di(tertiaryamyl) peroxide, or diisopropylperoxy carbonate azo initiators, e.g., 1,1'-azodicyclohexane-carbonitrile, 2,2'-azobis(2-methylpropionitrile).

The polymerization reaction can be carried out in the presence of an organic solvent. Preferably an alcohol and/or ketones are used when a solution polymerization technique is employed. The concentration of monomers can range from about 10 to 50% by weight, preferably about 30% weight.

Molecular weight can be controlled by varying the temperature or by varying the amount of catalyst used. The higher the initial temperature, the lower the molecular weight. As the amount of catalyst used increases the molecular weight decreases. Preferably, the polymerization reaction is performed in an inert atmosphere such as under a blanket of nitrogen. The polymerization mixture is maintained at a temperature at which the polymerization initiator generates free radicals. The exact temperature selected depends on the monomers being polymerized, the particular initiator being used, and the molecular weight desired. Temperatures ranging from room temperature or lower up to about 100° C. are suitable. It is usually desirable to carry the polymerization reaction substantially to completion so that no unpolymerized monomers remain and the proportions of each component in the final product are essentially those of the original monomer mixture.

The polymers can be collected and purified by conventional techniques, such as precipitation into a nonsolvent for the polymer followed by washing and drying.

The following specific procedures for making polymers which are useful in the present invention are illustrative.

SOLUTION POLYMERIZATION

To a 12 liter flask were added 5040 grams of ethyl alcohol, 560 grams of acetone, then 1440 grams of methyl methacrylate, 480 grams of methacrylic acid, and 480 grams of 2-acetoacetoxyethyl methacrylate. The solution was sparged with nitrogen. The flask was equipped with a reflux condenser and stirrer, and immersed in a 60° C. constant temperature bath. 12.0 Grams of 2,2'-azobis(2-methylpropionitrile) were added to the solution which was maintained at 60° C. for 16 hours. The resultant viscous solution had a bulk viscosity of 950,000 cps at 33% solids. $\eta$inh (inherent viscosity)=0.67 measured at 25° C. at a concentration of 0.25 grams of polymer per deciliter in a solution of acetoneethanol 4:1. Assay for acid=19.1%; for 2-acetoacetoxyethyl methacrylate=17.8%.

Emulsion Polymerization

To a 2 liter flask were added 500 milliliters of water and 12 milliliters of 40% Triton 770 a sodium salt of an alkylarylpolyether sulfate surfactant from Rohm and Haas and the solution was sparged with nitrogen. To an addition funnel were added 150 grams of methyl methacrylate, 50 grams of methacrylic acid, and 50 grams of 2-acetoacetoxyethyl methacrylate dispersed in 250 milliliters of water containing 6.75 milliliters of 40% Triton 770. All liquids were nitrogen sparged. To the solution in the addition funnel were added 1.25 grams of potassium persulfate ($K_2S_2O_8$). To the solution in the flask were added 0.625 grams of $K_2S_2O_8$ and 0.625 grams of sodium metabisulfite ($Na_2S_2O_5$). The contents of the funnel were added to the flask solution maintained at 60° C. with stirring for 0.5 hours. After the addition of the monomers, the latex solution was kept at 60° C. for 2 hours. The resultant polymer latex had a solid content of 25.1%.

Especially useful polymers for forming the electrophotographic elements of this invention include poly(methylmethacrylate-co-methacrylic acid-co-2-acetoacetoxyethylmethacrylate) hereinafter referred to as Polymer A. Using the foregoing methods this polymer was then prepared with the following monomer weight ratios and glass transition temperature:

| Polymer A Composition by Weight | Tg |
|---|---|
| 60:20:20* | 94 |
| 75:5:20* | 82 |
| 78:20:2* | 120 |
| 52:2:46* | 50 |

*Monomer percents by weight are stated in the same order as the respective monomers making up Polymer A are enumerated in the polymer name.

In accordance with the present invention, the photoconductive layer of an electrophotographic element is coated with a thin polymeric overcoat layer comprising a polymer according to the invention. The coatings may be applied by conventional techniques such as extrusion coating, spray coating and dip coating, etc.

Following application of the overcoat composition used in the present invention over the surface of a photoconductive layer of an electrophotographic element, the overcoat composition is cured or set. Typically this is accomplished by heating the overcoat-liquid-containing dope which has been applied to the surface of the electrophotographic element. Generally, heating in air at a temperature above 50° C., preferably from 65° C. to 125° C., for a short period (a few minutes to several hours) is sufficient to dry and cure the overcoat. Generally, some cross linking occurs in the overcoat when it is heated. The extent of cross linking depends upon the amount of component c in the polymer and the pH of the coating dope. As the amount of component c increases, cross linking increases. The pH should be at least 5.

Heating at relatively high temperatures is avoided to assure that no deleterious effect is produced on the photoconductive layer. Thus, the particular curing temperature selected will depend not only on the composition of the overcoat, but also on the particular photoconductive layer being overcoated. When overcoating organic photoconductor-containing layers, it is desirable to use relatively low curing temperature to avoid damaging the organic photoconductive material. Temperatures in the range of 50° C. to 125° C. are typical.

For example, an overcoat containing a polymer of the present invention and a melamine-formaldehyde resin cross-linking agent can be cured at a curing temperature within the range of 65° C. to 95° C. For this reason, the melamine-formaldehyde resins described in greater detail hereinafter have been found particularly advantageous as cross-linking agents for use in the present invention.

The overcoat layers of this invention which may include a filler (e.g. clay, silica, titanium dioxide) preferably have a dry thickness in the range of from 0.07 to 10 microns and preferably from 0.1 to 5 microns. Other layers making up the particular electrophotographic element in which the overcoat layers are used can have thicknesses selected in accordance with conventional practice in the art of electrophotography.

Coating aids such as plasticizers and surfactants may be used in forming the overcoats used in the present invention. Such coating aids can improve the spreadability of the coating composition and insure formation of a uniformly coalesced coating without surface discontinuities. Fugitive plasticizers are particularly effective. Less than 0.1% of the amount of fugitive plasticizer added remains in final overcoat. Fugitive plasticizers promote adhesion and coalescence of the overcoat to the substrate, and do not adversely alter the photoconductive properties of the element. Especially useful fugitive plasticizers may be selected from the class consisting of phenols and dihydroxybenzenes. Phenol and resorcinol are examples of phenols and dihydroxybenzenes.

The overcoat layers of the invention are preferably transparent or at least translucent to electromagnetic radiation of the type to which the underlying photoconductive composition is sensitive. Of course, if the conductive support on which the photoconductive composition is coated is transparent or translucent, the photoconductive composition may be exposed to electromagnetic radiation from the rear through the support. In such case the overcoat of the invention need not be transparent or translucent.

As is apparent, the overcoats of the present invention are electrically insulating. Typically, such overcoats have a specific resistivity on the order of at least $10^{10}$ ohm-cm. as measured at 50 percent relative humidity. This is, however, an approximate resistivity figure. Depending upon the particular electrographic process, overcoats having somewhat lower resistivities may also be useful.

As stated before, the polymeric overcoats of the present invention can be cross-linked. The cross-linking occurs through the active methylene groups and/or the carboxyl group contained in the polymer. However, cross-linking agents may be advantageously employed. Such cross-linking agents can be selected from any of a number of well-known substances widely used for this purpose. Exemplary materials include diepoxy reactive modifiers, such as 1,4-butanedioldiglycidyl ether, and aminoplast resins which are produced from the condensation products of amines or amides with an aldehyde. The most common aminoplast resins are urea-formaldehyde resins and melamine-formaldehyde resins. Some preferred aminoplasts are melamine hardeners including melamine-formaldehyde resins such as those available from the Rohm and Haas Co. under the registered Trade Mark of "Uformite" MM-47 and other melamine compounds such as hexamethoxy methylmelamine. Especially preferred melamine hardeners are the malemine formaldehyde resins. Others are "Uformite" MM-83, a methoxy methylmelamine resin and "Uformite" 240, a butylated urea-formaldehyde resin.

Imine terminated bifunctional or trifunctional prepolymers are also useful cross-linking agents. Such materials are well known in the art.

In general, the polymeric overcoats of this invention may contain from about one to about eight parts by weight of cross-linking agent for about every eight to about one part of the polymer.

Electrophotographic elements including the novel overcoat layer described herein can be made up solely of the electrically conductive support, the photoconductive insulating layer and the overcoat layer. Such elements may also include auxiliary layers between the support and the photoconductive layer if desired. An interlayer may also be used between the photoconductive layer and the novel overcoat.

The overcoated electrophotographic elements provided by the present invention can comprise any electrically conductive support suitable for use in electrophotography. For example, the support can be a sheet material having the appropriate conductivity, such as metal foil or conductive paper, on which the photoconductive insulating layer is coated. Alternatively, the support can be comprised of a polymeric film, such as a film of cellulose acetate, polyethylene, polypropylene, poly(ethylene terephthalate), covered with a conductive coating.

A number of different compositions and techniques are known for forming the conductive coating on the support. For example, the conductive coating can be applied by evaporative deposition of a suitable metal such as nickel. Or the coating can be made by applying a solution of a conductive or semi-conductive material such as conductive carbon particles and a resinous binder in a volatile solvent to a support and subsequently evaporating the solvent to form the coating. Vacuum deposition of the conductive or semi-conductive material is also useful. Metal containing semi-conductive compounds such as cuprous iodide or silver iodide provide conductive coatings with particularly good characteristics. Such useful conducting layers, both with and without insulating barrier layers, are described in U.S. Pat. No. 3,245,833.

This invention is further illustrated by the following examples. In each of the examples, the electrophotographic element tested is prepared by coating a conductive support with a suitable photoconductive composition. The conductive support comprises a poly(ethylene terephthalate) film base, optionally bearing an adhesive subbing layer, upon which is coated a layer of nickel, formed for example, by vacuum evaporation. Over the conducting nickel layer is coated a photoconductive layer comprising an organic photoconductor, a binder, and a co-crystalline complex of a resin and a thiapyrylium dye as is described in U.S. Pat. No. 3,873,311 noted earlier herein. An overcoated layer as described herein is coated over the latter photoconductive layer. In each example a control electrophotographic element in which the overcoat is omitted is prepared in the same manner.

In general the Formula 1 polymers are diluted to about 5% solids for coating. Solution polymers are diluted by slowly adding a liquid such as methyl or ethyl alcohol to a well stirred concentrated solution of said polymer. In the case of latex (emulsion) formed polymers, dilution is accomplished by simple addition of the latex composition with distilled water. In most cases, the spreadability of the latex formed polymer coating solution can be improved by the addition of a surfactant such as Triton X-100 (oxyphenoxy polyethoxy ethanol from Rohm & Haas). In cases where the surfactant does not properly plasticize the polymer to permit coalescence, (i.e., resulting in open structured films) at maximum allowed coating machine temperatures, complete coalescence can be accomplished by the addition of a fugitive plasticizer such as resorcinol.

In each example, the overcoat composition is applied by hopper coating techniques. After the application of the overcoat layer, the overcoated elements and the control elements are tested by measuring the relative electrical speeds, amount of wear and regeneration capability of each element. Regeneration capability refers to the ability of an element to retain its V log E curve and charge acceptance throughout successive cycling.

To obtain wear resistance data each electrophotographic element was processed through 40,000 imaging cycles. Each imaging cycle includes charging, exposing, developing in a magnetic brush development station and image transfer. In each of the examples the amount of wear is defined herein to mean the difference between the original thickness of the photoconductive layer and its thickness after 40,000 processing cycles divided by the original thickness of the photoconductive layer at the beginning of the first cycle multiplied by 100.

The relative speed measurements reported in this and the following examples are relative H & D electrical speeds. The relative H & D electrical speeds measure the speed of a given photoconductive material relative to other materials typically within the same test group of materials. The relative speed values are not absolute speed values. However, relative speed values are related to absolute speed values. The relative electrical speed (shoulder or toe speed) is obtained simply by arbitrarily assigning a value, Ro, to one particular absolute shoulder or toe speed of one particular photoconductive material. The relative shoulder or toe speed, Rn, of any other photoconductive material, n, relative to this value, Ro, may then be calculated as follows: $Rn=(A_n)(Ro/Ao)$ wherein An is the absolute electrical speed of the first material. The absolute H & D electrical speed, either the shoulder or toe speed, of a material may be determined as follows: The material is electrostatically charged under, for example, a corona source until the surface potential, as measured by an electrometer probe, has an initial value $V_o$, of about 600 volts. The charged element is then exposed to a 3000° K. tungsten light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure required to reduce the surface potential to any fixed selected value. The actual positive or negative shoulder speed is the numerical expression of $10^4$ divided by the exposure in meter-candle-seconds required to reduce the initial surface potential $V_o$ to some value equal to $V_o$ minus 100. This is referred to as the 100 volt shoulder speed. Sometimes it is desirable to determine the 50 volt shoulder speed and, in that instance, the exposure used is that required to reduce the surface potential to $V_o$ minus 50. Similarly, the actual positive or negative toe speed is the numerical expression of $10^4$ divided by the exposure in meter-candle-seconds required to reduce the initial potential $V_o$ to an absolute value of 100 volts. Again, if one wishes to determine the 50 volt toe speed, one merely uses the exposure required to reduce $V_o$ to a value of 50 volts. An apparatus useful for determining the electrophotographic speeds of photoconductive compositions is described in Robinson et al., U.S. Pat. No. 3,449,658, issued June 10, 1969.

EXAMPLE 1

293 Grams of poly(methyl methacrylate-co-methacrylic acid-co-2-acetoacetoxyethyl methacrylate) (Polymer A-60/20/20) solution (8.7% solution in ethanol-/acetone 84/16 weight ratio) were diluted with 207 grams of ethanol while stirring to prepare a 5% solution of the polymer. The polymeric solution was coated over the photoconductive layer of the above described electrophotoconductive element at 0.05 grams/m$^2$ and dried for 6–7 minutes at 25°–121° C. The overcoat adhered well to the substrate. Electrical and wear data for this element are presented in Table I. Polymer A has a Tg of 94° C.

EXAMPLE 3

The following overcoat formulation was prepared and coated over an electrophotoconductive element as described in Example 1.

| | |
|---|---|
| Polymer A-60/20/20 latex supplied at 5% solids. | 500 grams |
| Triton X-100 surfactant | 1.25 grams |

The overcoat adhered well to the interlayer and substrate. Electrical and wear data for this element are presented in Table I.

Table I shows that the overcoated electrophotoconductive elements provided by the present invention have greatly improved wear resistance. Moreover the overcoats responsible for this improvement in wear resistance did not have an adverse effect on the electrical properties of said elements. In the examples where there was a decrease in speed or regeneration capability in the overcoated element, as compared to the uncoated element, such decrease was insignificant or well within experimental error.

TABLE I

| Example | Overcoat | $V_o/V_{min}$[1] | Electrical H + D Speed 250V | 500V Regeneration[2] $V_1$ | $V_3$ | V Log E | Wear |
|---|---|---|---|---|---|---|---|
| 1 | Control, no overcoat | 630/0 | 100[3] | 30 | 30 | 0 | 66% |
| 1 | Polymer A-60/20/20 | 620/15 | 107 | 40 | 30 | 0 | 13% |
| 2 | Control, no overcoat | 630/0 | 100[3] | 10 | 10 | 0 | 52% |
| 2 | Polymer A-60/20/20 + cross linking agent | 600/15 | 90 | 0 | 0 | 0 | 18% |
| 3 | Control, no overcoat | 620/0 | 100[3] | 5 | 0 | 0 | 61% |
| 3 | Polymer A-60/20/20 latex | 620/0 | 100 | 5 | 0 | 0 | 22% |

[1] $V_o/V_{min}$ is maximum charge acceptance/residual charge after exposure
[2] Voltage drop between 1st and 500th charge at $V_1$ (shoulder), $V_3$ (toe), and speed change
[3] Speed of each control arbitrarily asssigned a value of 100

EXAMPLE 2

The following interlayer was prepared and coated over the photoconductive layer of an electrophotoconductive element as in Example 1, at 0.015 grams/m$^2$ and dried as in Example 1.

| | |
|---|---|
| Poly(methyl acrylate-co-vinylidene chloride-co-itaconic acid) in a 14.7/83.3/2 weight ratio, supplied at 26.2% solids | 37.5 grams |
| $H_2O$ | 462.5 grams |
| Triton X-100 surfactant | 2.0grams |

The following overcoat formulation was prepared and coated using the same polymer solution as in Example 1 on the above interlayer.

| | |
|---|---|
| Polymer A-60/20/20 (8.7% solution) | 212 grams |
| Formaldehyde (5% solution in ethanol) | 25 grams |
| Uformite MM-83 (A methoxymethylmelamine resin supplied by Rohm & Haas) 5% solution in ethanol. | 125 grams |
| Ethanol | 138 grams |

Electrical and wear data for this element are presented in Table I.

The invention has been described in detail with particular reference to certain especially useful aspects and embodiments thereof, but it will be understood that variations and modifications can be effected within the spirit and scope of the invention.

We claim:

1. An electrophotographic element having a electrically insulating overcoat layer, wherein said overcoat layer comprises a polymer having recurring units according to the structure:

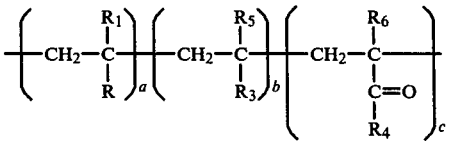

in which

R represents phenyl, tolyl, xylyl or

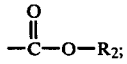

$R_1$, $R_5$ and $R_6$, which may be the same or different, represent hydrogen or methyl;

$R_2$ represents alkyl or aryl;

$R_3$ represents a carboxyl, alkyl ester, aryl ester, alkylamide or arylamide group having at least one carboxyl or hydroxyl or carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

2. An overcoat layer as in claim 1, wherein said layer comprises a polymer having recurring units according to the structure:

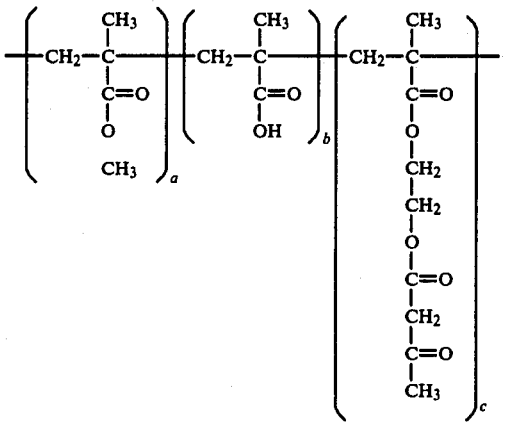

a is 50 to 80 weight percent of said polymer;

b is 2 to 25 weight percent of said polymer; and c is 2 to 25 weight percent of said polymer.

3. An overcoat layer as in claim 2 wherein a, b and c represents 60, 20 and 20 weight percent respectively.

4. An overcoat layer as in claims 1, 2 or 3, wherein said layer also comprises a cross linking agent.

5. An overcoat layer as in claims 1, 2 or 3 wherein said polymer has a molecular weight of about 200,000 to about 2,000,000.

6. An overcoat layer as in claims 1, 2 or 3 wherein said polymer has a glass transition temperature of about 40° to about 120° C.

7. A photoconductive element comprising, in the following order:

a support;

an electrically conducting layer;

a photoconductive layer; and an electrically insulating overcoat layer; wherein said overcoat layer includes a polymer having recurring units according to the structure:

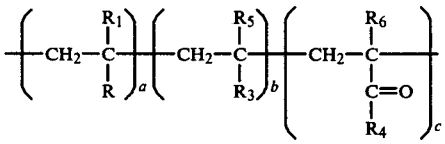

in which

R represents phenyl, tolyl, xylyl or

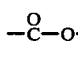

$R_1$, $R_5$ and $R_6$, which may be the same or different, represent hydrogen or methyl;

$R_2$ represents alkyl or aryl;

$R_3$ represents carboxyl, alkyl ester, aryl ester, alkylamide or arylamide group having at least one carboxyl or hydroxyl or carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

8. An element according to claim 7 wherein said polymer has recurring units according to the following structure:

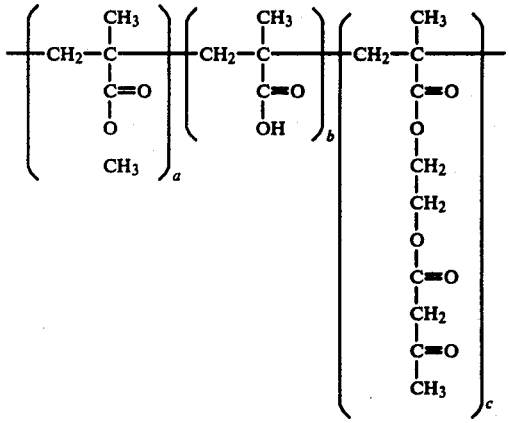

9. An element according to claim 8 wherein a, b and c are 60, 20 and 20 weight percent respectively.

10. An element according to claim 7 or 8, wherein said overcoat includes a cross linking agent.

11. A photoconductive element comprising, in the following order:

a support;

an electrically conducting layer;

an organic photoconductive layer; wherein said overcoat layer includes a polymer having recurring units according to the structure:

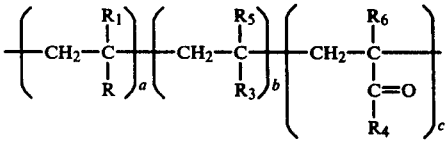

in which

R represents phenyl, tolyl, xylyl or

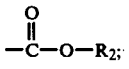

$R_1$, $R_5$ and $R_6$, which may be the same or different, represent hydrogen or methyl;

$R_2$ represents alkyl or aryl;

$R_3$ represents a carboxyl, alkyl ester, aryl ester, alkylamide or arylamide group having at least one carboxyl or hydroxyl or carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

12. An element according to claim 11 wherein said polymer has recurring units according to the following structure:

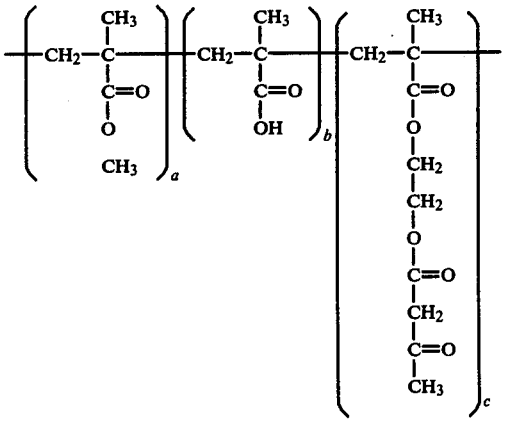

a is 50 to 80 weight percent of said polymer;

b is 2 to 25 weight percent of said polymer; and c is 2 to 25 weight percent of said polymer.

13. An element according to claim 11 or 12, wherein said organic photoconductive layer is an aggregate photoconductive layer.

14. An element according to claim 11 or 12, wherein said overcoat layer includes a cross-linking agent.

15. An element according to claim 12 wherein a, b and c are 60, 20 and 20 weight percent respectively.

16. In an electrophotographic image forming process wherein an image is formed on a photoconductive element comprising in the following order:

a support;

an electrically conducting layer;

a photoconductive layer; and an overcoat layer, the improvement wherein said overcoat layer includes a polymer having recurring units according to the structure:

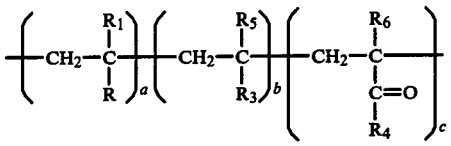

in which

R represents phenyl, tolyl, xylyl or

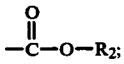

$R_1$, $R_5$ and $R_6$, which may be the same or different, represent hydrogen or methyl;

$R_2$ represents alkyl or aryl;

$R_3$ represents a carboxyl, alkyl ester, aryl ester alkylamide or arylamide group having at least one carboxyl or hydroxyl or carboxylic anhydride substituent;

$R_4$ represents a group containing an active methylene group;

a is about 29 to about 96 weight percent of said polymer;

b is about 2 to about 25 weight percent of said polymer; and c is about 2 to about 46 weight percent of said polymer.

* * * * *

UNITED STATES PATENT AND TRADEMARK OFFICE

CERTIFICATE OF CORRECTION

PATENT NO. : 4,181,526

DATED : January 1, 1980

INVENTOR(S) : Blakey and Sutton

It is certified that error appears in the above-identified patent and that said Letters Patent are hereby corrected as shown below:

Column 11, last line, $-\overset{O}{C}-O-R_2$ should read $-\overset{O}{\overset{\|}{C}}-O-R_2$ .

Signed and Sealed this

Tenth Day of March 1981

[SEAL]

Attest:

RENE D. TEGTMEYER

Attesting Officer

Acting Commissioner of Patents and Trademarks